US005354010A

United States Patent [19]

Loos

[11] Patent Number: 5,354,010

[45] Date of Patent: Oct. 11, 1994

[54] WINDING SHAFT WITH CLAMPING DEVICE FOR CARDBOARD WINDING TUBES

[75] Inventor: Gerhard Loos, Horrenberg, Fed. Rep. of Germany

[73] Assignee: Heidelberger Druckmaschinen AG, Heidelberg, Fed. Rep. of Germany

[21] Appl. No.: 970,291

[22] Filed: Nov. 2, 1992

[30] Foreign Application Priority Data

Oct. 31, 1991 [DE] Fed. Rep. of Germany ..... 4135892

[51] Int. Cl.[5] ..... B65H 75/24

[52] U.S. Cl. ..... 242/571.8; 242/598

[58] Field of Search ..... 242/72 R, 72.1, 68.2; 269/48.1; 279/2.17

[56] References Cited

U.S. PATENT DOCUMENTS

| | | | |
|---|---|---|---|
| 163,217 | 5/1875 | Lawson | 279/2.17 |
| 1,197,774 | 9/1916 | Smith | 242/72 R |
| 2,066,659 | 1/1937 | Templeton et al. | 242/72 R |
| 2,466,974 | 4/1949 | Stupakoff et al. | 279/2.17 |
| 2,638,282 | 5/1953 | Prevost et al. | 242/72 R |
| 2,647,701 | 8/1953 | Cannard | 279/2.17 |
| 2,733,022 | 1/1956 | Grody | 242/72 R |
| 3,106,767 | 10/1963 | Fox | 242/72 R |
| 3,166,263 | 1/1965 | Smith, Jr. et al. | 242/46.4 |
| 3,248,976 | 5/1966 | Gerstein et al. | 242/72.1 |
| 3,448,937 | 6/1969 | Beck | 242/72 R |
| 3,645,466 | 2/1972 | Karlson | 242/72.1 |
| 3,780,962 | 12/1973 | Sykora | 242/72 R |
| 3,828,489 | 8/1974 | Culley, Jr. | 242/72 R X |
| 3,941,328 | 3/1976 | Johnson | 242/68.4 |
| 4,154,412 | 5/1979 | Briar et al. | 242/72 R X |
| 4,317,577 | 3/1982 | Cameron | 242/72 R X |
| 4,422,590 | 12/1983 | Rathbone | 242/72 R X |

FOREIGN PATENT DOCUMENTS

| | | |
|---|---|---|
| 2362207 | 6/1974 | Fed. Rep. of Germany . |
| 3116289 | 11/1982 | Fed. Rep. of Germany . |
| 3744105 | 7/1989 | Fed. Rep. of Germany . |
| 3636457 | 9/1989 | Fed. Rep. of Germany . |

*Primary Examiner*—Daniel P. Stodola
*Assistant Examiner*—John P. Darling
*Attorney, Agent, or Firm*—Herbert L. Lerner; Laurence A. Greenberg

[57] ABSTRACT

A combination of a winding shaft and a clamping device for a cardboard winding tube slid onto the winding shaft is provided, wherein the clamping device includes a clamping rod received in respective first and second end parts so that the end parts are braced axially opposite to one another by the clamping rod, a sleeve formed of rigid material mounted coaxially on the clamping rod, and at least one radially acting and elastically deformable annular clamping element for frictionally locking together the winding shaft and a winding tube slid onto the winding shaft, the clamping element being of annular shape and being disposed coaxially on the clamping rod between the first end part and the sleeve, a first bearing member mounted in a first side part of a housing having two side parts, a plug-in coupling having a device for connecting the first end part to the first bearing member, and a second bearing member mounted in a second side part of the housing for supporting the second end part.

8 Claims, 3 Drawing Sheets

WINDING SHAFT WITH CLAMPING DEVICE FOR CARDBOARD WINDING TUBES

The invention relates to a winding shaft with a clamping device for a cardboard winding tube, particularly for taking up a washcloth or washing blanket of a cylinder-washing device in a printing machine, wherein radially acting, elastically deformable clamping elements effect frictional locking between the winding shaft and a winding tube which has been slid onto the winding shaft.

A winding shaft with such structural features has become known heretofore from a company advertisement R 1255 of the firm Deublin Gerätebau GmbH, 6234 Hattersheim 2, Germany. For transmitting a drive torque, the winding shaft, which is insertable through the winding tube, is provided in the clamping region with a multiplicity of radially extensible clamping elements which are punch or plunger-shaped and act either directly against the inner cylindrical surface of the winding tube or against radially expandable clamping shells. The radially directed clamping movement of the punch-shaped clamping elements is executed by pneumatic, hydraulic or mechanical means. The torque is applied to the winding shaft by an entrainer mounted in a frame or the like and formed with axially directed recesses, in which radially directed pins on the winding shaft engage, or by similar intermeshing positive or form-locking elements. The use of such a winding shaft in cylinder or roller-washing devices in printing machines has not been known heretofore. Factors opposing such a use would be the heavy weight and the expensive construction.

Non-positive or force-locking, friction-type clamping means for web reels have also become known from German Published Non-Prosecuted Application (DE-OS) 37 44 105.

German Published Non-Prosecuted Application (DE-OS) 23 62 207 discloses an hydraulically expandable clamping mandrel for web reels. In accordance therewith, a hose to which a pneumatic or hydraulic pressure medium can be applied, is disposed spirally between an inner core and outer clamping shells. Clamping sleeves which are expandable under internal hydraulic pressure have become known heretofore from German Published Non-Prosecuted Application (DE-OS) 31 16 289. Because of their great weight, these constructions, too, are unsuitable for the purpose pursued by the invention.

In contrast therewith, the currently practiced state of the art with respect to cardboard winding tubes in a cylinder-washing device in printing machines is represented by simple and lightweight arrangements wherein, for example, according to German Patent 36 36 457, end inserts are inserted into slotted ends of the winding tube, the end inserts having projections which positively or form-lockingly engage the slots in the winding tube and are mounted in a frame. One of these end inserts is couplable with a driving device. The shocks and jolts which occur intermittently during washing call for special measures, however, to prevent the slots in the winding tube from being torn out and expanded, particularly when soaked or saturated with washing agents or when subjected to overloading. It has likewise become known heretofore to line the cardboard winding tube with a stiffening or reinforcing sleeve in order to protect it against bending and in order to improve its absorption of the axial clamping forces.

It is accordingly an object of the invention to provide an improvement in a winding shaft with a clamping device for cardboard winding tubes without positive or form-locking entraining elements in cylinder-washing devices in printing machines with regard to the operational reliability thereof in order largely to prevent damage to the winding tube as a result of overloading and/or saturation or soaking.

With the foregoing and other objects in view, there is provided, in accordance with the invention, in combination, a winding shaft and a clamping device for a cardboard winding tube slid onto the winding shaft, the clamping device comprising a clamping rod received in respective first and second end parts so that the end parts are braced axially opposite to one another by the clamping rod, a sleeve formed of rigid material mounted coaxially on the clamping rod, and at least one radially acting and elastically deformable annular clamping element for frictionally locking together the winding shaft and a winding tube slid onto the winding shaft, the clamping element being of annular shape and being disposed coaxially on the clamping rod between the first end part and the sleeve, first bearing means mounted in a first side part of a housing having two side parts, a plug-in coupling having means for connecting the first end part to the first bearing means, and second bearing means mounted in a second side part of the housing for supporting the second end part.

In accordance with another feature of the invention, another clamping element is coaxially disposed on the clamping rod, with the sleeve located between both of the clamping elements.

In accordance with a further feature of the invention, another clamping rod is received in other first and second end parts, and a plurality of the clamping elements are disposed on the clamping rods, with a plurality of the sleeves disposed therebetween so as to brace the respective first and second end parts axially opposite one another.

These construction features provide secure support for the winding tube over the entire length thereof and a greatly effective force-locking frictional connection between the winding shaft and the cardboard winding tube. This force-locking frictional lock is effective over 360 degrees in the circumferential direction of the winding shaft, so that possible damage to the cardboard winding tube due to shocks and jolts during washing is largely prevented. It is possible, above all, to employ cardboard winding tubes without special driving devices. The device according to the invention is of relatively simple construction and is resistant to the loading or stressing occurring in day-to-day operations. It is advantageous for a plurality of clamping elements and spacer sleeves disposed between the clamping elements to be braced axially against one another by end parts, with a clamping bolt for effecting axial bracing extending through the entire length of the winding tube and thus serving as a supporting core.

In accordance with an added feature of the invention, the connecting means of the plug-in coupling comprise complementary elements, respectively, formed on the first end part and on the first bearing means.

In accordance with an additional feature of the invention, a bushing is provided supporting the first bearing means, the bushing being connectible to a drive.

In accordance with yet another feature of the invention, the clamping rod is formed with an annular shoulder at a drive end, the clamping rod being braced with the annular shoulder against the first end part, and being formed thereat with a threaded pin engaging in a female thread formed in the first end part, and an actuating bolt is firmly connected to the clamping rod at the other end thereof, the actuating bolt being formed with an annular shoulder and being braced therewith against an inner annular shoulder formed on the second end part.

In accordance with yet a further feature of the invention, the clamping element is formed of elastic material.

In accordance with yet an added feature of the invention, the threaded pin has a free end extending out of the female thread, and a retaining ring is mounted on the free end of the threaded pin for preventing the threaded pin from being unscrewed from the female thread.

In accordance with yet an additional feature of the invention, the free end of the threaded pin extends into a clearance bore formed in the first bearing means.

In accordance with a concomitant feature of the invention, the complementary elements of the plug-in coupling are automatically interlockable by rotation when clamping forces are applied to the clamping elements, so as to prevent axial movement of the first end part and of the winding shaft.

Other features which are considered as characteristic for the invention are set forth in the appended claims.

Although the invention is illustrated and described herein as embodied in a winding shaft with a clamping device for cardboard winding tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
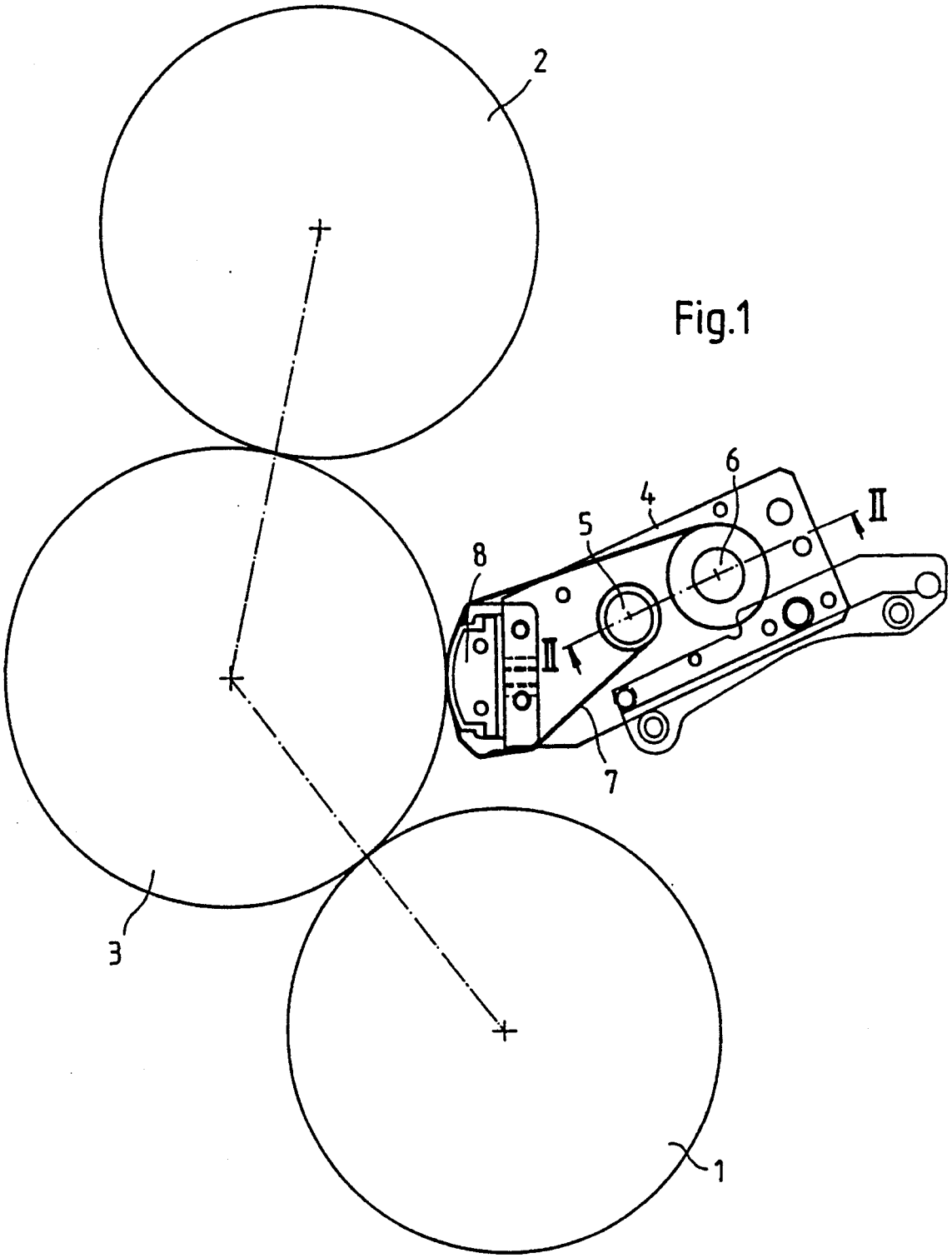
FIG. 1 is a diagrammatic side elevational view of a cylinder-washing device in a sheet-fed rotary offset printing machine.

Referring now to the drawings and, first, particularly to FIG. 1 thereof, there is shown therein a cylinder-washing device for a rubber-covered or blanket cylinder 3 of a sheet-fed rotary offset printing machine, the blanket cylinder 3 being disposed between a plate cylinder 1 and an impression cylinder 2. Supported in a housing frame 4 by two side parts 4*a* and 4*b* (FIG. 2) are two winding shafts 5 and 6 having axes extending parallel to one another and to the axis of the blanket cylinder 3. A cylinder-washing blanket or washcloth 7, which runs off the winding shaft 5, is pressed against the outer cylindrical surface of the blanket cylinder 3 by a pressure-applying device 8 and is then wound onto the winding shaft 6, which is connected to a drive for a sheet feeder of the printing machine.

Figure 2:
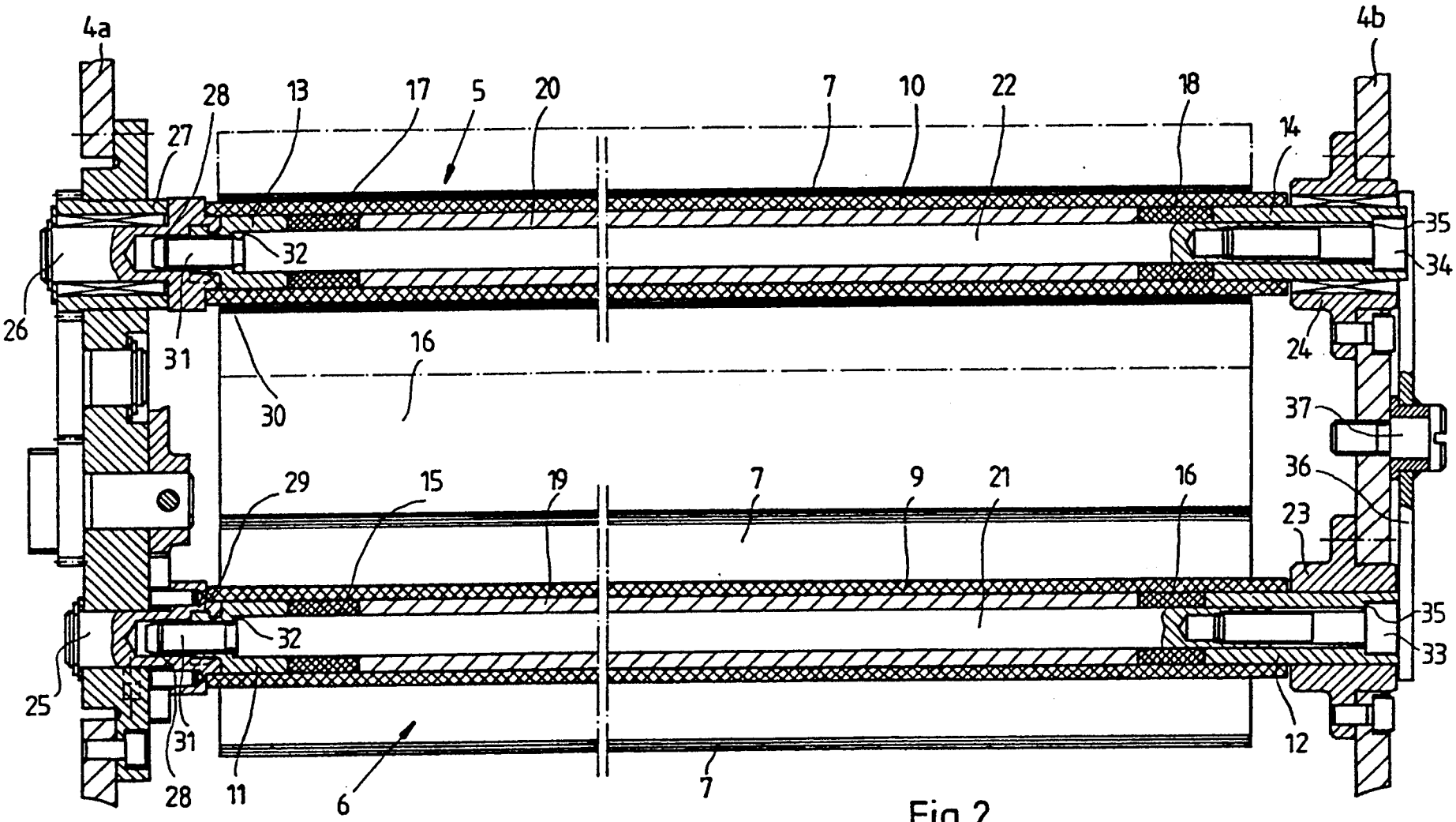
FIG. 2 is an enlarged fragmentary longitudinal sectional view of FIG. 1 taken along the line II—II in the direction of the arrows.
Figure 3:
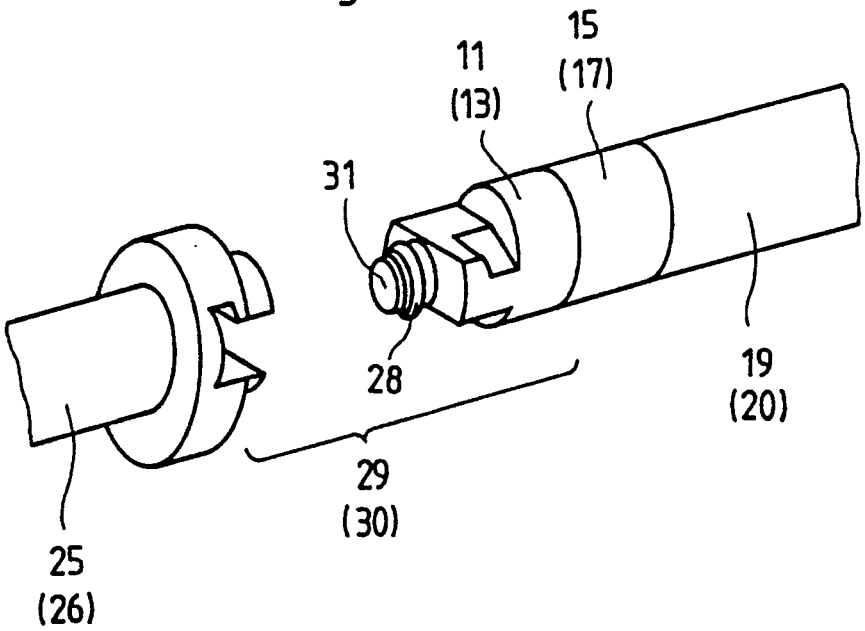
FIG. 3 is a perspective exploded view of a coupling for mutually connecting one end part and a driven entrainer so that they are fixed against rotation relative to one another.

FIG. 2 shows the construction of the winding shafts on an enlarged scale compared to that of FIG. 1. A cardboard winding tube 9 is provided for a clean washing blanket 7 on the winding shaft 5 and, similarly, a winding tube 10 of cardboard or the like serves for winding up the washing blanket 7 on the winding shaft 6. Both winding shafts 5 and 6 are formed identically of end parts 11 and 12; 13 and 14, respectively, of one or more annular clamping elements 15 and 16; 17 and 18, respectively, as well as of interposed spacer sleeves 19; 20, respectively. The clamping elements 15 and 16; 17 and 18, respectively, are formed of elastic material, whereas the spacer sleeves 19; 20, respectively, are formed of rigid or solid material. Clamping rods 21 and 22, respectively, extend into the end parts 11 and 12; 13 and 14, respectively, of each winding shaft 5 and 6, respectively, and also pass through the clamping elements 15 and 16; 17 and 18, respectively, as well as through the spacer sleeves 19 and 20, respectively, so that these components are supported radially inwardly on the respective clamping rods 21 and 22.

One end part 12,14 of each winding shaft 5,6 is rotatably mounted on the side part 4*b* of the frame 4 so as to have limited axial mobility. The other end part 11,13 of each winding shaft 5,6 is connectible, through the intermediary of a plug-in coupling, to a bearing member 25,26, so as to be axially tension-proof. In order to transmit a drive torque for feeding the cylinder-washing blanket 7, the bearing member 26 is mounted, so as to be rotatable yet axially fixed, in a bushing 27 in the side part 4*a* of the housing frame 4, and is connected to a non-illustrated driving device. The complementary parts of the plug-in couplings 29 and 30 are formed, on the one hand, on the bearing members 25 and 26, respectively, and, on the other hand, on the end parts 11 and 13, respectively, and are made up, for example, of one or more cams formed on one part, and one or more corresponding recesses formed in the other part, so that the complementary parts of the plug-in couplings 29 and 30, respectively, interlock by rotation when the clamping forces are applied to the clamping elements 15,16 and 17, 18, respectively, and thus prevent axial movement of the end parts 11 and 13, respectively, and of the winding tube 9 and 10, respectively. The clamping rod 21,22 has a threaded pin 31 threadedly engaging in a female thread formed in the respective plug-in coupling 29 and 30, the threaded pin 31 having a free end extending into a clearance bore formed in the respective bearing member 25 and 26.

The respective clamping rod 21,22 is formed, at a transition location thereof to the threaded pin 31, with an annular shoulder 32, which is braced against an inner annular shoulder of the respective end part 11,13 and acts as a travel limiter for the axial movement of the respective clamping rod 21,22 relative to the respective end part 11,13. At the other end of each clamping rod 21,22, respectively, a respective actuating bolt 33,34 with an annular shoulder 35 is firmly inserted therein so that a rotation of the actuating bolt 33,34 causes a rotation of the respective clamping rod 21,22, with a consequent screwing of the threaded stud 31 into the female thread of the respective plug-in coupling 29,30. Because of a shortening of the clamping length between the two end parts of a winding shaft, axial clamping forces are generated which press the respective clamping elements 15,16 and 17,18 together, so that they are deformed radially outwardly and, with their outer surface, press against the inner cylindrical surface of the respective winding tube 5,6, in order to produce the force-locking or friction-type connection between the respective winding shaft 5,6 and the respective winding tube 9,10. Due to the screwing motion and due to the axial clamping forces, the complementary elements of the respective plug-in coupling 29,30 are simultaneously engaged (coupled). In order to change the cylinder-washing blanket 7 and the winding tubes or sleeves 9,10, the actuating bolt 33,34 is rotated in the opposite direction, so that the threaded stud 31 is unscrewed from the respective plug-in coupling 29,30. In the course thereof, the complementary elements of the plug-in coupling are also loosened, so that they become disengaged, thereby permitting the respective clamping rod 21,22, together with the respective end parts 11,12 and 13,14 supported thereon, as well as the interposed respective clamping elements 15,16 and 17,18, and the respective spacer sleeves 19,20, to be withdrawn to the right-hand side through the appropriately dimensioned respective bearing 23,24 in the side part **4*b*, in order to allow the respective winding tube 9,10 to be changed. In order to prevent the threaded stud 31 from being unscrewed from the female thread, a retaining ring 28 is provided on the free end of the threaded stud 31**.

The insertion of a new winding tube occurs in reverse order, in that the clamping rod, with the elements and spacer sleeves disposed thereon, is inserted from the right-hand side through the winding tube until the corresponding elements of the plug-in coupling and the bearing members engage. In order to prevent an undesired movement of the winding shaft out of the side part **4*b* or to prevent the operator, such as a pressman, from forgetting to apply the force-locking or friction-type connection with the winding tube, a safety plate 36 is provided, which covers the ends of the respective winding shaft 5,6 and is fastenable to the side part 4*b* by means of a bolt 37**. It is also possible to provide, in a conventional manner, a reverse-winding lock, a pull-back safety device for the cylinder-washing blanket, as well as other heretofore known constructive features.

The foregoing is a description corresponding in substance to German Application P 41 35 892.9, dated Oct. 31, 1991, the International priority of which is being claimed for the instant application, and which is hereby made part of this application. Any material discrepancies between the foregoing specification and the aforementioned corresponding German application are to be resolved in favor of the latter.

I claim:

1. In combination, a winding shaft and a clamping device for a cardboard winding tube slid onto the winding shaft, the clamping device comprising a clamping rod received in respective first and second end parts so that said end parts are braced axially opposite to one another by said clamping rod, a sleeve formed of rigid material mounted coaxially on said clamping rod, and at least one radially directed and elastically deformable annular clamping element for frictionally locking together the winding shaft and a winding tube slid onto the winding shaft, said clamping element being of annular shape and being disposed coaxially on said clamping rod between said first end part and said sleeve, first bearing means, for supporting said first end part, mounted in a first side part of a housing having two side parts, a plug-in coupling having means for connecting said first end part to said first bearing means, and second bearing means mounted in a second side part of said housing for supporting said second end part, said connecting means of said plug-in coupling comprising mating complementary elements, respectively, formed on said first end part and on said first bearing means.

2. The combination according to claim 1, including another clamping element coaxially disposed on said clamping rod, with said sleeve located between both said clamping elements.

3. The combination according to claim 1, including a bushing supporting said first bearing means, said bushing being connected to a drive.

4. The combination according to claim 1, wherein said clamping rod is formed with an annular shoulder at a drive end, said clamping rod being braced with said annular shoulder against said first end part, and being formed at said annular shoulder with a threaded pin engaging in a female thread formed in said first end part, and including an actuating bolt firmly connected to said clamping rod at the other end thereof, said actuating bolt being formed with an annular shoulder and being braced therewith against an inner annular shoulder formed on said second end part.

5. The combination according to claim 4, wherein said threaded pin has a free end extending out of said female thread, and including a retaining ring mounted on said free end of said threaded pin for preventing said threaded pin from being unscrewed from said female thread.

6. The combination according to claim 4, wherein said free end of said threaded pin extends into a clearance bore formed in said first bearing means.

7. The combination according to claim 1, wherein said clamping element is formed of elastic material.

8. The combination according to claim 1, wherein said complementary elements of said plug-in coupling have means for interlocking said clamping elements by rotation when clamping forces are applied to said clamping elements so as to prevent axial movement of said first end part and of the winding shaft.

* * * * *